US005751216A

United States Patent [19]

Narumiya

[11] Patent Number: 5,751,216

[45] Date of Patent: May 12, 1998

[54] PROJECTED BEAM-TYPE SMOKE DETECTOR AND RECEIVING UNIT

[75] Inventor: Junichi Narumiya, Fujisawa, Japan

[73] Assignee: Hochiki Kabushiki Kaisha, Tokyo, Japan

[21] Appl. No.: 529,269

[22] Filed: Sep. 15, 1995

[51] Int. Cl.[6] ..... G08B 17/10

[52] U.S. Cl. ..... 340/630; 340/628; 250/574; 356/438

[58] Field of Search ..... 340/628, 630; 250/573, 574; 356/438, 437

[56] References Cited

U.S. PATENT DOCUMENTS

| | | | |
|---|---|---|---|
| 4,015,135 | 3/1977 | Tipton, Jr. | 250/574 |
| 4,126,396 | 11/1978 | Hartmann et al. | 250/573 |
| 4,827,247 | 5/1989 | Giffone | 340/630 |
| 5,477,218 | 12/1995 | Manmoto et al. | 250/574 |

*Primary Examiner*—Jeffery Hofsass
*Assistant Examiner*—Daniel J. Wu
*Attorney, Agent, or Firm*—Lackenbach Siegel Marzullo Aronson & Greenspan, PC

[57] ABSTRACT

A projected beam-type smoke detector and receiving unit includes in its light receiver data output unit 118 for outputting serially status information and status signal output units 85, 86 for sending the status information to the receiving unit, and in its receiving unit 30 data examining unit 113 for examining sequentially the status information. The light receiver 31 also includes a pulse generator unit 82 for generating pulses having different pulselengths according to the type of alarm information, and photoelectric converter units 83, 84 for sending to the receiving unit 120 the pulses of different pulselengths generated by the pulse generator unit 82. The receiving unit 120 includes a pulselength determining unit 108 for determining the type of alarm information from the pulselength of the pulse sent by the projected beam-type smoke detector and display units 110, 111 for displaying the alarm information type determined by the pulselength determining unit 108. As a result, the alarm and status information is conducted by single lines. Simple and low-cost design is thus implemented into the projected beam-type smoke detector and receiving unit.

12 Claims, 10 Drawing Sheets

Fig.5

| A/D CONVERTED VALUE | LIGHT INPUT DROP RATIO(%) |
|---|---|
| 00～31 | SETTING |
| 32～47 | 15 |
| 48～63 | 20 |
| 64～79 | 25 |
| 80～95 | 30 |
| 96～111 | 35 |
| 112～127 | 40 |
| 128～143 | 45 |
| 144～159 | 50 |
| 160～175 | 55 |
| 176～191 | 60 |
| 192～207 | 65 |
| 208～223 | 70 |
| 224～239 | 75 |
| 240～255 | 80 |

PRIOR ART

PROJECTED BEAM-TYPE SMOKE DETECTOR AND RECEIVING UNIT

BACKGROUND OF THE INVENTION

1. Field of the Invention

The present invention relates to a projected beam-type smoke detector having separately a light emitter and a light receiver, and a receiving unit that receives a variety of alarm information and status information from the projected beam-type smoke detector. The present invention in particular relates to a projected beam-type smoke detector and a receiving unit, in which a simple design achieves transfer of a variety of alarm information and status information from a light receiver to the receiving unit.

2. Description of the Prior Art

The projected beam-type smoke detector is typically mounted at an elevated high place, and checking its operation and reading is occasionally difficult. For this reason, a receiving unit that receives signals from the smoke detector is mounted at a lower place within easy reach where its operation and reading are checked without difficulty. In the performance test of the projected beam-type smoke detector, its optical path cannot be directly blocked, while a smoke detector mounted at a higher place allows its optical path to be blocked by setting some filters between a light emitter and a light receiver. To cope with this problem, the projected beam-type smoke detector is provided with a tester unit mounted at a lower place. By operating the tester unit, pseudo-fire state is generated to conduct performance tests.

One projected beam-type smoke detector proposed has a simplified design in which a receiving unit also functions as a tester unit.

The light receiver of the prior art projected beam-type smoke detector sends a variety of alarm information including a fire signal and an irregularity signal when the light receiver detects a fire or possibly any unusual state in the detector itself or glitches caused of interrupted light between a light emitter and a light receiver by any obstacles. The light receiver also sends the fire signal and irregularity signal to some type of receiving unit such as a tester unit that conducts performance test to the photoelectric smoke detector. The tester unit indicates that it has detected a fire or a glitch.

When a light receiver 3 detects a fire in FIG. 11, it sends a fire signal over a fire signal line 29A and common line 29B to a receiver 6. At the same time the light receiver 3 turns on a fire switch 5 sending the fire signal to a tester unit 1. Power terminals 7, 8 in the receiver 6 are connected to power terminals 9, 10 in the tester unit 1 to feed power. Power terminal 9 is connected to terminal 11 of two terminals 11 and 12 of the fire switch 5. Receiving the fire signal from the light receiver 3, the tester unit 1 causes a fire LED 13 to light, indicating a fire.

When the light receiver 3 detects a glitch, it sends an irregularity signal over an irregularity signal line 29C to the receiver 6 and turns on an irregularity switch 14 to send the irregularity signal to the tester unit 1. Power is supplied to one terminal 15 of the two terminals 15, 16 of the irregularity switch 14 via the power terminal 9. Upon receiving the irregularity signal from the light receiver, the tester unit 1 causes an irregularity LED 17 to light, indicating the occurrence of the glitch.

To conduct a performance test on the projected beam-type smoke detector, a test switch 2 is turned on in the tester 1. A test signal is sent to a test terminal 4 in the light receiver 3 of the projected beam-type smoke detector. Upon receiving the test signal on its test terminal 4 from the tester unit 1, the light receiver 3 generates a pseudo-fire state, turning on the fire switch 5 and sending the fire signal to the tester unit 1. When the tester unit 1 receives the fire signal from the light receiver 3, it causes the fire LED 13 to light to indicate that the light receiver 3 operates normally.

When a monitor jack 18 is connected in the tester unit 1, the monitor jack 18 is connected to the light receiver 3 via terminals 19, 20. The light input level the light receiver 3 is currently receiving is compensated for a light input level drop attributed to dirt on the detector window cover, and the variety of alarm information including the compensated light input level data is sent to the tester unit 1 to be monitored.

Alternatively, monitoring terminals (not shown) may be provided in the light receiver 3 or tester unit 1, and a voltmeter or other monitoring device may be connected to the monitoring terminals to read out light input level or compensated light input level (for example U.S. Pat No. 4,651,013).

The tester unit 1 and light receiver 3 are connected via a power line 21, a fire signal line 22, an irregularity signal line 23, a common line 24, a test signal line 25 and a monitoring signal line 26.

The tester unit 1 and receiver 6 are connected via power lines 27, 28.

In such a prior art projected beam-type smoke detector and receiving unit, the light receiver regularly monitors variations in light input level due to dirt on the surface of the detector and computes a compensation ratio to match the present light input level against its initial value in order to compensate for the variation. Thereafter, the current light input level is multiplied by compensation ratio to make it compatible with its initial light input level. However, the light receiver sends only the compensated light input level obtained by multiplying the current light input level by the compensation ratio, the monitoring jack in the receiving unit (corresponding to the monitoring jack 18 in the tester unit 1 in FIG. 11) allows the compensated light input level only to be monitored. The receiving unit therefore cannot know the current compensation ratio due to dirt on the detector cover surface, and thus cannot know how dirty the detector cover surface is.

Since only the compensated light input level is monitored, other status information including one for settings of the detector remains unknown. The prior art projected beam-type smoke detector thus suffers from an insufficient reliability and poor inspection operation efficiency.

To collect other types of status information than compensated light input level, more signal lines should be run between the light receiver and the receiving unit. An increased number of signal lines makes the system complex, thus increased complicacy of setting and cost, and is an impracticable alternative.

Even when the receiving unit is designed to receive a minimum number of types of alarm information, namely the fire information and irregularity information, dedicated signal lines for the fire and irregularity signals are required and costly to install.

SUMMARY OF THE INVENTION

In view of the above described problems, the present invention has been developed. It is an object of the present invention to provide a projected beam-type smoke detector and its associated receiving unit, in which a plurality of types of status information are transferred to the receiving unit over a single signal line to allow the status of the light receiver to be distinctly recognized.

It is another object of the present invention to provide a projected beam-type smoke detector and its associated receiving unit, which incorporate a simple and low-cost design by allowing a single signal line to conduct a plurality of types of alarm information, wherein when a light receiver sends a plurality of alarm information to the receiving unit, different pulselengths are used to represent different types of alarm information so that the light receiver sends a pulse of which pulselength matches the current information to be sent and the receiving unit identifies the alarm information currently being received by its pulselength to indicate the type of alarm information currently received.

FIG. 1 shows one construction of the invention to achieve the above objects.

To achieve the above objects, the projected beam-type smoke detector according to the present invention is constructed of a light emitter 42 having a light emitting element 53 and a light receiver 31 having a light receive element 54 separately mounted from the light emitter unit in order to detect the light attenuation due to the presence of smoke between the light emitting element 53 and the light receive element 54, said light receiver 31 sending to a receiving unit 30 a plurality of types of status information including light receive state data and setting state date of a diversity of setting values, said projected beam-type smoke detector comprising:

data output means 118 in the light receiver 31 for outputting serially the plurality of types of status information; and status signal output means 85, 86 for sending the plurality of types of status information from the data output means 118 to said receiving unit 30.

The present invention thus constructed allows the plurality of types of status information to be conducted over a single line without the need for a dedicated line for each type of status information. The design of the system is simplified and the cost of the system is reduced.

According to an aspect of the present invention, the plurality of types of status information includes current light input level, compensation ratio, sensitivity and initial value.

The present invention thus provide not only the compensated light input level as in the prior art but also the current light input level, compensation ratio, sensitivity and the initial value of light input level. Therefore, the status of the light receiver is more exactly monitored.

According to another aspect of the present invention, a receiving unit is included in a projected beam-type smoke detector that is constructed of a light emitter having a light emitting element and a light receiver having a light receive element separately mounted from the light emitter unit in order to detect the light attenuation due to the presence of smoke between the light emitting element and the light receive element, said receiving unit receiving from said light receiver a plurality of types of status information including light receive state data and setting state date of a diversity of setting values, said receiving unit comprising data analyzing means for sequentially analyzing said plurality of types of status information.

The plurality of types of status information output by the light receiver are sequentially analyzed. The types of status information are thus determined without the need for separate transmission link.

According to another aspect of the present invention, the receiving unit is a tester unit which conducts a performance test by sending a test signal to the projected beam-type smoke detector.

A plurality of types of status information are analyzed and integrally displayed on the tester unit. One can quickly come to grips with the status of the light receiver. Since no extra display is required, the system is simplified.

According to another aspect of the present invention, the receiving unit preferably comprises display means for displaying the analyzed data provided by said data analyzing means.

The display means presents the status information analyzed by the data analyzing means, allowing one to quickly come to grips with the status information.

According to another aspect of the present invention, the receiving unit preferably comprises display means for displaying the analyzed data provided by said data analyzing means.

The present invention therefore allows the present data to be compared with the past data by storing onto the memory means the analyzed data provided by the data analyzing means.

According to another aspect of the present invention, the receiving unit comprises output means for outputting the data stored in the memory means.

The output means thus allows the data stored in the memory means to be read to the outside, for example into a computer or a printer. One can thus quickly come grips to the status of the light receiver through a variety of means.

According to another aspect of the present invention, the projected beam-type smoke detector is constructed of a light emitter having a light emitting element and a light receiver having a light receive element separately mounted from the light emitter unit in order to detect the light attenuation due to the presence of smoke between the light emitting element and the light receive element, said light receiver sending to a receiving unit a plurality of types of alarm information, said projected beam-type smoke detector comprising in said light receiver:

pulse generator means for generating pulses having different pulselengths according to the type of said alarm information; and alarm signal means for sending to said receiving unit the pulses having different pulselengths generated by said pulse generator means.

According to another aspect of the present invention, a receiving unit is included in a projected beam-type smoke detector that is constructed of a light emitter having a light emitting element and a light receiver having a light receive element separately mounted from the light emitter unit in order to detect the light attenuation due to the presence of smoke between the light emitting element and the light receive element, said receiving unit receiving from the light receiver a plurality of types of alarm information, said receiving unit comprising:

pulselength determining means for identifying the type of the alarm information by recognizing the pulselength of the pulse sent from the projected beam-type smoke detector; and display means for displaying the alarm information identified by the pulselength determining means.

In the present invention arranged as above, the light receiver generates pulses having different pulselengths according to the type of alarm information. The alarm signal means sends pulses to the receiving unit, where a determination is made of whether the incoming pulse is a fire signal or an irregularity signal, referring to the pulselength of the incoming pulse. The determined alarm information is displayed. Unlike the prior art that needs dedicated lines for each of the fire signal and irregularity signal, a single line works to conduct both signals. The design of the system is thus simplified and the cost of the system is reduced.

According to another aspect of the present invention, the receiving unit is a tester unit which conducts a performance test by sending a test signal to the projected beam-type smoke detector.

A plurality of types of status information are analyzed and integrally displayed on the tester unit. One can quickly come to grips with the status of the light receiver. Since no extra display is required, the system is simplified.

According to another aspect of the present invention, said plurality of types of alarm information comprise a fire signal and an irregularity signal.

In this arrangement, both the fire signal and irregularity signal are transmitted over a single line and then displayed.

According to another aspect of the present invention, said pulselength determining means comprises reset means which resets the pulselength determining when the reset means is pressed for a predetermined duration of time.

In this arrangement, by pressing the reset means for the predetermined duration of time, the pulselength determining means is reset or recovered to its original state.

BRIEF DESCRIPTION OF THE DRAWINGS

FIG. 5 shows a sensitivity table.

DETAILED DESCRIPTION OF THE PREFERRED EMBODIMENTS

Figure 1:
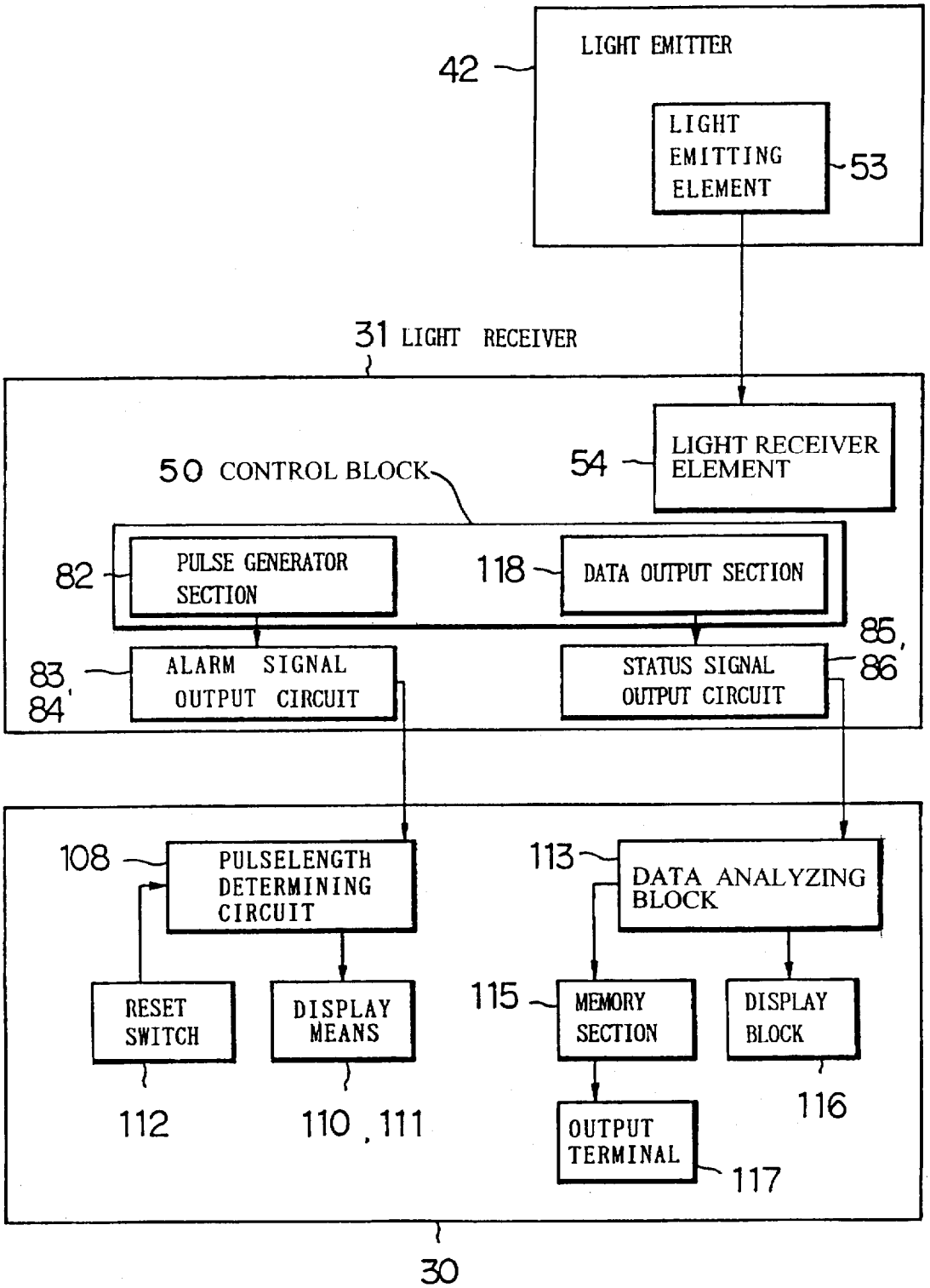
FIG. 1 illustrates the principle of the present invention.

Referring now to the drawings, the embodiments of the present invention are discussed.

Figure 2:
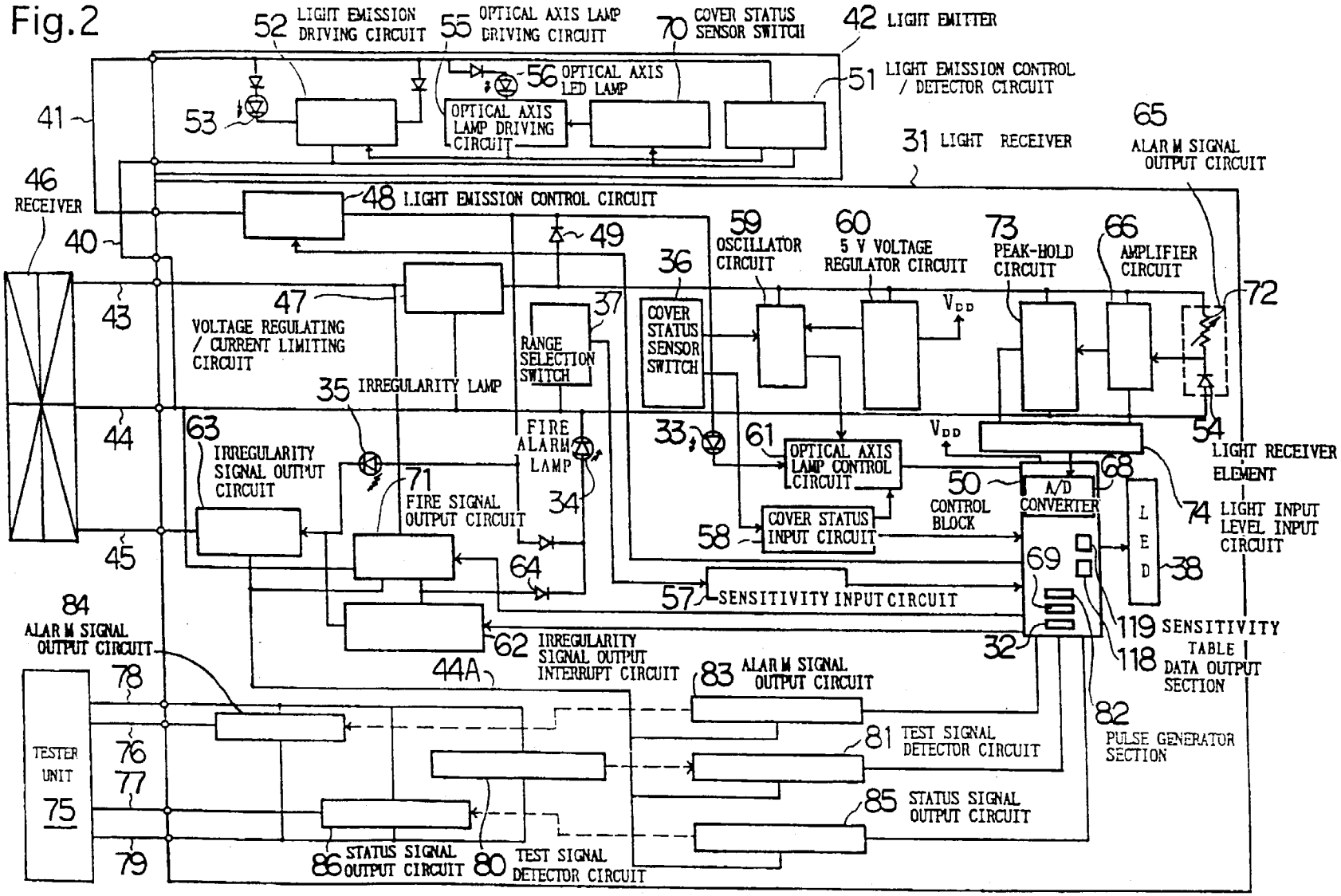
FIG. 2 is a block diagram showing generally an embodiment of the present invention.

In the discussion that follows, the receiving unit is assumed to be the tester unit. FIGS. 2 through 10 show the one embodiment of the present invention. FIG. 2 shows generally the one embodiment of the present invention.

In FIG. 2, a light receiver 31 of a projected beam-type smoke detector is connected to a light emitter 42 via light emitter control lines 40, 41.

The light receiver 31 is also connected to a receiver 46 via a fire signal line 43, a common line 44 and an irregularity signal line 45.

Designated 47 is a voltage regulating/current limiting circuit disposed in the light receiver 31. With power supplied by the receiver 46, the voltage regulating/current limiting circuit 47 generate a voltage regulated, current limited power and distributes it to all sections in need. A light emission control circuit 48 controls the light emission operation of the light emitter unit 42. The voltage regulating/current limiting circuit 47 supplies constant regulated voltage via a diode 49 to the light emission control circuit 48 which in turn feeds the constant regulated voltage to the light emitter unit 42 via the light emitter control line 41.

Designated 51 is a light emission control/detector circuit disposed in the light emitter unit 42. The light emission control/detector circuit 51 detects the light emission control signal from the light receiver 31 to activate a light emission driving circuit 52. Namely, the light emission control/detector circuit 51 detects power cutoff durations that are the light emission control signal from the light emission control circuit 48, and activates the light emission driving circuit 52. Driven by the light emission driving circuit 52, an LED 53 flashes and emits near-infrared light in pulse toward a light receive element 54 in the light receiver 31.

Designated 55 is an optical axis lamp driving circuit disposed in the light emitter unit 42. The optical axis lamp driving circuit 55 is activated by the light emission control signal from the light emission control/detector circuit 51 and an open-state signal (off signal) from a cover status sensor switch 70 that senses the status of the cover of the light emitter unit 42. The optical axis lamp driving circuit 55 drives an optical axis LED lamp 56 to flash it.

Designated 37 is a range selection switch in the form of a DIP switch disposed in the light receiver 31. The range selection switch 37 gives via a sensitivity input circuit 57 to a control block 50 a signal representing the standard sensitivity and determined by a monitoring range set. The control block 50 computes a threshold level (fire level) based on both the initial value that is a light input level with all the required adjustments completed and the cover closed and a sensitivity set, and stores the threshold level as a reference signal to RAM 32.

The control block 50 compares the reference signal with a light input level signal. When the light input level signal is smaller than the reference signal, the control block 50 determines that a fire has broken out and outputs the fire signal to a fire signal output circuit 71.

When the cover status sensor switch 36 in the light receiver 31 detects the opening of the cover, it gives an open-state signal (off signal) to the control block 50 and an oscillator circuit 59 via a cover status input circuit 58. When it detects the closing of the cover, the cover status sensor switch 36 gives a close-state signal (on signal) to the control block 50 and the oscillator circuit 59.

The oscillator circuit 59 oscillates when it receives both the open-state signal from the cover status sensor switch 36 and a 5 V regulated input a 5 V voltage regulator circuit 60 gives at the input of the constant regulated voltage by the voltage regulating/current limiting circuit 47. The oscillation output of the oscillator circuit 59 is sent to an optical axis lamp control circuit 61. The optical axis lamp control circuit 61 causes an optical axis lamp 33 to flash, in response to the oscillation output of the oscillator circuit 59 and the open-state signal from the cover status input circuit 58.

When the control block 50 detects a fire during monitoring (for example, a light input drop ratio of 70% continues for a predetermined duration), the control block 50 outputs its signal to the fire signal output circuit 71, which in turn gives the fire signal to the receiver 46. Under this condition, if an irregularity is detected (for example, a light input drop ratio of 90% continues for a predetermined duration), the control block 50 prevents the irregularity signal from being output by blocking the irregularity signal from overriding the fire signal.

In response to the output from the fire signal output circuit 71, an irregularity signal output interrupt circuit 62 cuts off the irregularity signal from the control block 50. This action may be redundant, because the control block 50 is designed to prevent the irregularity signal during fire signal. Should the irregularity signal be given during fire signal, it will not be sent to the receiver 46.

When the control block 50 detects a glitch due to blocking (for example, a light input drop ratio of 90% continues for a predetermined duration), the control block 50 sends its output to an irregularity signal output circuit 63 which in turn sends the irregularity signal to the receiver 46.

When a glitch takes place or when normal monitoring operation is interrupted (for example, a light input drop ratio of 90% continues for a predetermined duration), the control block 50 outputs the irregularity signal. In response to the irregularity signal, the irregularity lamp 35 flashes to indicate the occurrence of the glitch. The irregularity signal output circuit 63 sends the irregularity signal over the irregularity signal line 45 to the receiver 46.

When detecting the fire signal from the control block 50, the fire signal output circuit 71 causes the fire lamp 34 to flash via a diode 64. The fire signal output circuit 71 also sends the fire signal to the receiver 46 over the fire signal line 43.

Designated 54 is a light receive element, made of a photodiode, disposed in the light receiver 31. The light receive element 54 receives near-infrared light that is generated in pulse by a light emitting element 53. The alarm signal output circuit 65 is made up of the light receive element 54 and a potentiometer 72. The light input signal is converted by a alarm signal output circuit 65 into electrical signal, which is then amplified by an amplifier 66. By turning the light input level controls to vary the resistance of the potentiometer 72, a photoelectric conversion voltage is varied to control the light input level. The analog electrical signal amplified by the amplifier circuit 66 is processed by a peak-hold circuit 73, and sent to the control block 50 via a light input level input circuit 74. The control block 50 is constructed of an integrated circuit and contains an A/D converter 68. The analog signal is converted into a digital signal by the A/D converter 68.

The control block 50 stores a table 69 for driving LEDs 38 as monitor display means. Referring to its table 69, the control block 50 drives each of the LEDs 38.

A tester unit 75 sends a test signal to the light receiver 31, generating pseudo-fire state and conducting a performance test to the projected beam-type smoke detector. The tester unit 75 receives several types of alarm information and several types of status information. The alarm information includes the fire signal and irregularity signal and indicates unusual state of detector. The status information includes light input level, compensation ratio, sensitivity (light input drop ratio) and initial light input value, and indicates light receiving state and setting state of a diversity of setting values.

The contents of the alarm and status information described above are for example only. Other alarm information may be included in the alarm information, and other numerical information may be included in the status information. For example, instead of the sensitivity signal in the status information, a fire level signal that has been calculated relative to the sensitivity level may be output.

The tester unit 75 is typically power supplied by a nearby alternating current source. Alternatively, the tester unit 75 may be power supplied by the receiver 46.

The tester unit 75 is connected to the light receiver 31 via a signal line 76 for conducting the alarm information, a signal line 77 for conducting the status information, a test signal line 78 for conducting a test signal and a common line 79. In contrast to the prior art in which each signal line needs two-wire link, the present invention needs only a single wire 76 to transmit both the fire signal and irregularity signal from the light receiver 31 to the tester unit 75, without the need for a dedicated line for each signal.

Furthermore, the status information is also transmitted from the light receiver 31 to the tester unit 75 via the single line 77, rather than multiple lines as in the prior art.

The tester unit 75 feeds the test signal via test signal detector circuits 80, 81 as test signal detector means to the control block 50, where the test signal is identified. When the control block 50 identifies the test signal, it generates a pseudo-fire state sending the fire signal to the receiver 46.

The control block 50 contains a pulse generator section 82 as pulse generator means, which generates a plurality of pulses with different pulselengths according to the type of alarm information. For example, the pulse generator section 82 generate a 10 ms pulse indicative of a fire and a 5 ms pulse indicative of a glitch. Pulses with different pulselengths from the pulse generator section 82 are sent to the tester unit 75 via alarm signal output circuits 83, 84 as alarm signal means.

The control block 50 serially sends a variety of status information to the tester unit 75 via status signal output circuits 85, 86 as status signal output means.

The control block 50 also contains a data output section 118 as data output means which sends a variety of status information to the tester unit 75. Namely, the data output section 118 sends to the tester unit 75 several types of status information, piece by piece serially and sequentially in the form of digital signal. When all types of status information are sent, the transmission of another cycle starts over.

Figure 3:
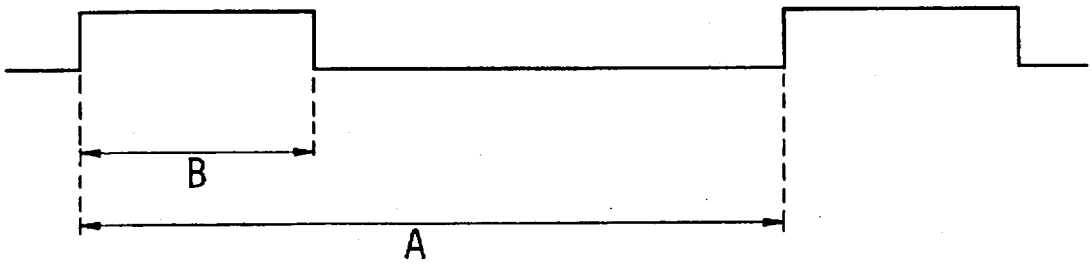
FIG. 3 shows the method of sending data.

The status information or data is sent to the tester unit 75 at a data rate of 1200 bps. The status data are transmitted at the timing as shown in FIG. 3, approximately every 3 seconds (as denoted by the letter A) in synchronism with A/D conversion command. The pulselength of the data transmission is 8.33 ms (as denoted by the letter B) in this embodiment.

Figure 4:
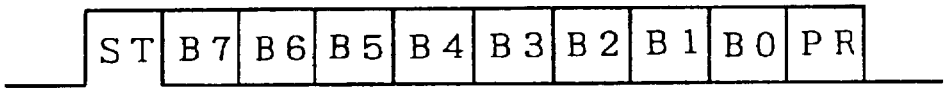
FIG. 4 shows the structure of data.

As shown in FIG. 4, a single data is constructed of 10 bits: a start bit, data bits (8 bits) and a parity bit. Five types of data block are transmitted, one block at a time. Namely, one full frame of data is constructed of: block 1 for start data, block 2 for current light input level, block 3 for compensation ratio, block 4 for sensitivity, and block 5 for initial value.

Since the status information or data is sequentially transmitted, it is necessary to recognize which one is the start data. For this reason, the parity bit for the start data is set to be an odd parity while the parity bits of the remaining data are all set to be even parity. Once the odd parity, namely, the start data is recognized, the rest of the status information that follows is automatically collected because the order of the data is known (current light input level, compensation ratio, sensitivity and initial value).

As shown in FIG. 2, the control block 50 is provided with a sensitivity table 119. The control block 50 reads an A/D converted value given by the A/D converter 68, and determines sensitivity referring to the sensitivity table 119 in FIG. 5. The sensitivity input circuit 57 contains sensitivity setting resistors connected in series with a reference resistor. The range selection switch 37 switches the sensitivity setting resistors to perform voltage division. The divided voltage is applied to the A/D converter 68. The control block 50 reads the A/D converted value and converts it to the corresponding sensitivity value referring to the sensitivity table 119.

The alarm signal output circuit 83, test signal detector circuit 81 and status signal output circuit 85 are connected to the receiver 46 via a common line 44A and a common line 44, over which the receiver 46 supplies power. The alarm signal output circuit 84, test signal detector circuit 80 and status signal output circuit 86 are power supplied by the tester unit 75.

Figure 6:
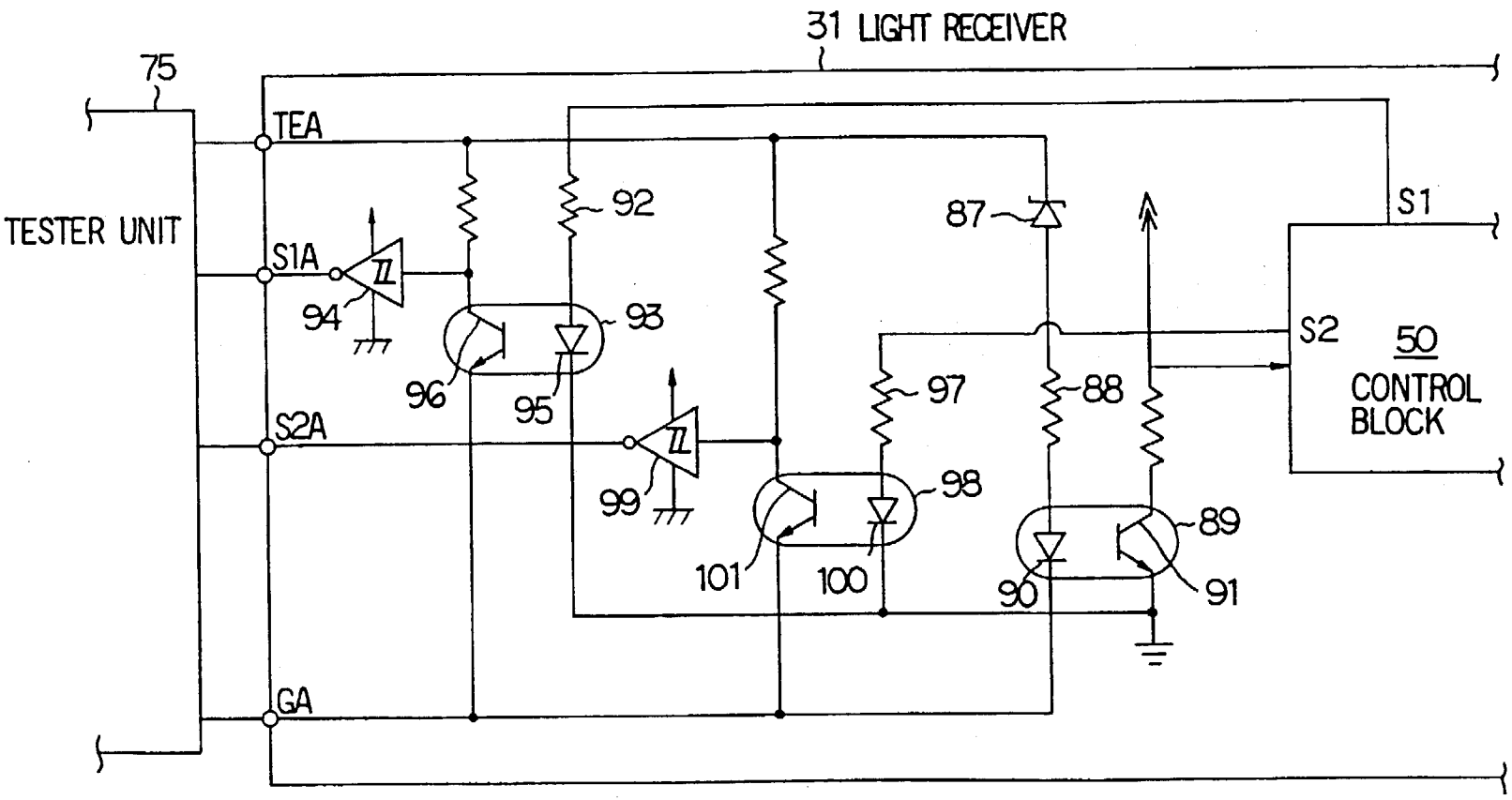
FIG. 6 is a schematic diagram showing the junction block between the control block of the light receiver and the tester unit.

FIG. 6 shows the junction block between the control block 50 of the light receiver 31 and the tester unit 75. In FIG. 6, the test signal from the tester unit 75 goes to a terminal TEA on the light receiver 31, a zener diode 87, a resistor 88 and a photocoupler 89 and then reaches the control block 50.

The light emitting diode 90 of the photocoupler 89 constitutes the test signal detector circuit 80 (from FIG. 2), and a phototransistor 91 constitutes the test signal detector circuit 81.

The pulses representing the alarm information from the control block 50 are sent to the tester unit 75 via a resistor 92, a photocoupler 93, an inverter 94 where the pulses are inverted, and a terminal S1A. The light emitting diode 95 of the photocoupler 93 constitutes the alarm signal output circuit 83. A phototransistor 96 constitutes the alarm signal output circuit 84.

The pulses representing the status information from the control block 50 are sent to the tester unit 75 via a resistor 97, a photocoupler 98, an inverter 99 where the pulses are inverted, and a terminal S2A. The light emitting diode 100 of the photocoupler 98 constitutes the status signal output circuit 85, and a phototransistor 101 constitutes the status signal output circuit 86.

Figure 7:
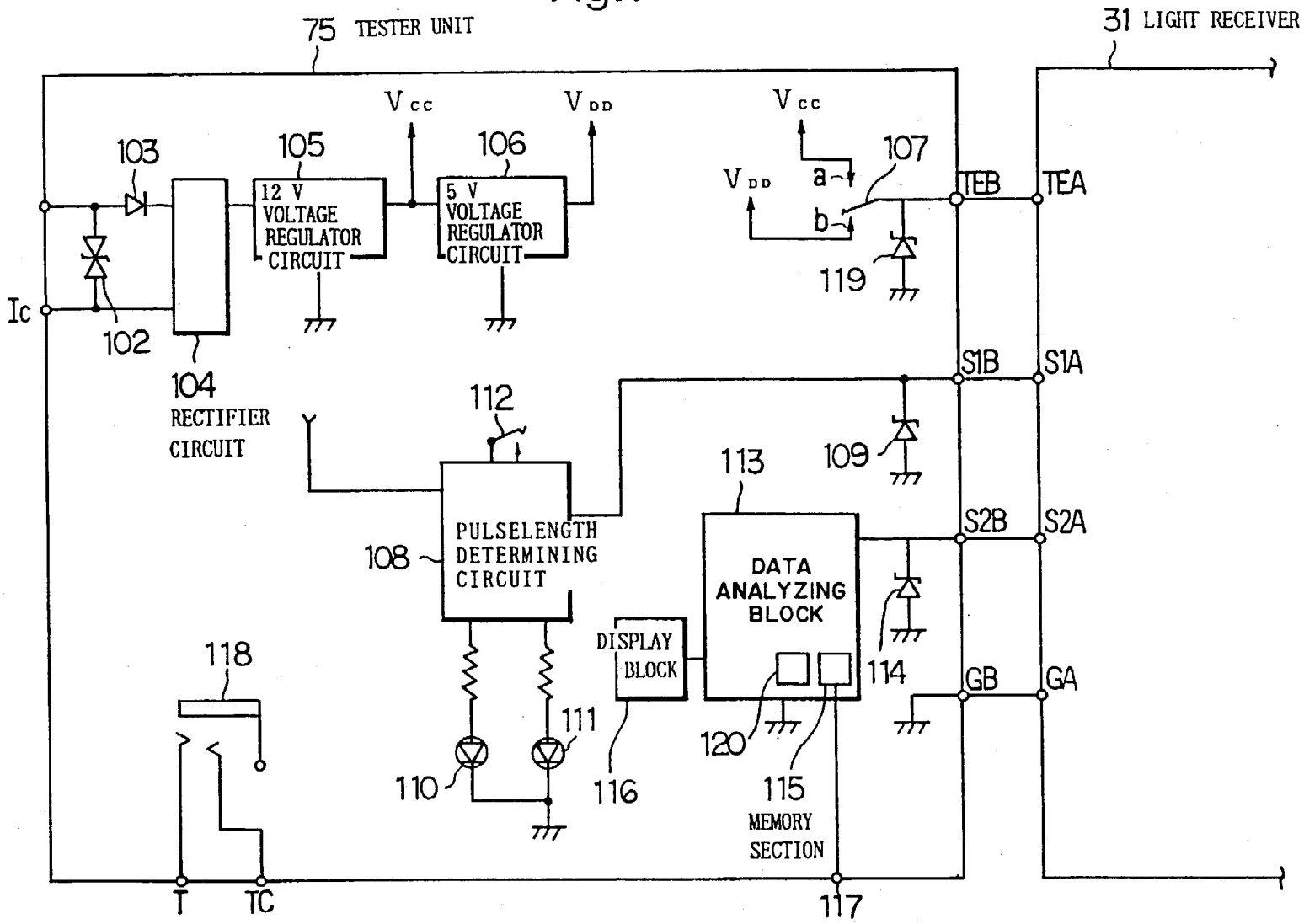
FIG. 7 is a block diagram showing the internal structure of the tester unit.

FIG. 7 is the block diagram showing the internal structure of the tester unit 75. As shown in FIG. 7, designated I+, Ic are terminals, across which an alternating current is supplied. The alternating current across I+, Ic is applied to a zener diode 102 and a diode 103, where its noise component is removed, and then applied to a rectifier circuit 104, where it is rectified. The rectified voltage is applied to a 12 V voltage regulator circuit 105 and a 5 V voltage regulator circuit 106. Regulated 12 V and 5 V supplies are distributed to all electronics in need.

Designated 107 is a non-lock type test switch which, if connected to a contact point a during test, outputs a 12 V test signal from a terminal TEB to the light receiver 31. Designated 119 is a zener diode that becomes conductive at 15 V. The zener diode 119 prevents a test signal above 15 V from being fed to the light receiver 31. When the test switch 107 is turned to its contact point b, the 5 V supply is connected to the light receiver 31. The test switch 107 is normally turned to the contact point b side.

S1B is a terminal to which pulses of different pulselengths indicative of the alarm information are applied. The pulses coming in at the terminal S1B are fed to a pulselength determining circuit 108 as pulselength determining means, where their pulselengths are determined. The voltage of the incoming pulses is limited to 15 V by a zener diode 109 that becomes conductive at 15 V.

The pulselength determining circuit 108 determines the pulselength of an incoming pulse. For example, when the pulselength is 10 ms, the pulselength determining circuit 108 identifies the incoming pulse as a fire signal; when the pulselength is 5 ms, the pulselength determining circuit 108 identifies the incoming pulse as an irregularity signal.

When the pulselength determining circuit 108 identifies the incoming pulse as a fire signal, it causes a red fire lamp 110 as indicator means to light. When the pulselength determining circuit 108 identifies the incoming pulse as an irregularity signal, it causes a yellow irregularity lamp 111 as indicator means to light.

Designated 112 is a reset switch disposed in the pulselength determining circuit 108 as reset means. The reset switch 112 is of a non-lock type. When the reset switch 112 is pressed continuously for a predetermined duration, for example 3 seconds, the pulselength determining circuit 108 is reset, causing the fire lamp 110 and irregularity lamp 111 to go off.

S2B is a terminal to which a variety of status data is applied. Data incoming at the terminal S2B are sequentially analyzed by a data analyzing block 113 as data analyzing means. Designated 114 is, for example, a zener diode that becomes conductive at 15 V. The zener diode prevents incoming voltage from going beyond 15 V.

The data analyzing block 113 is provided with a sensitivity table 120 in FIG. 5, and converts received A/D converted data into a sensitivity value referring to the sensitivity table 120.

Analyzed data given by the data analyzing block 113 are stored temporarily in a memory section 115 and at the same time displayed on a display block 116. The data stored in the memory section 115 are ready to be read via an output terminal 117.

Designated 118 is a phone jack. By connecting the phone jack, a phone link is established between the tester unit 75 and the receiver 46.

Figure 8:
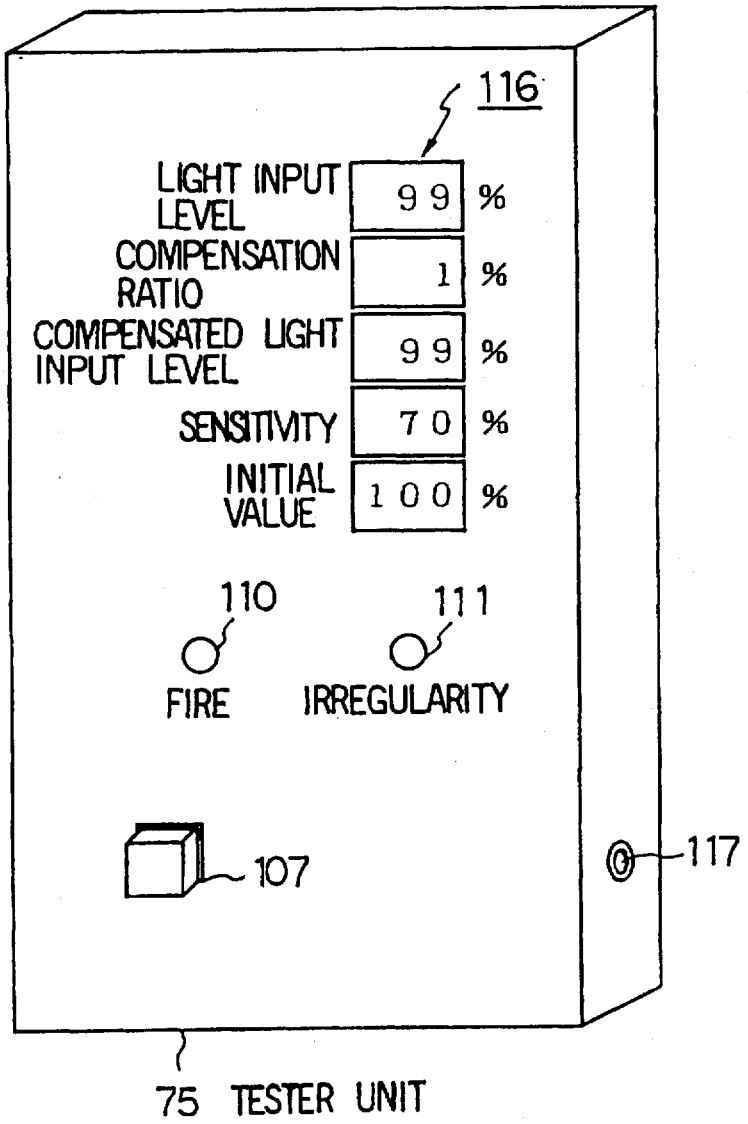
FIG. 8 is a perspective front view of the tester unit.

FIG. 8 is the perspective front view of the tester unit 75. As shown in FIG. 8, the display block 116 displays light input level, compensation ratio, compensated light input level, sensitivity and initial value. Also provided are the fire lamp 110 and irregularity lamp 111. Designated 107 is the test switch.

To indicate distinctly, each type of status information is read by %. Assuming that the current light input level is 100% and the compensation ratio −1%, the compensated light input level is 99%. The initial value may be set to be 100%, and other values may be expressed in % relative to the initial value.

Units of reading on the display block 116 is not limited to %. Units of reading may be volts, or A/D converted numerical value.

The operation of the transmission and reception of the alarm and status information is now discussed.

The operation of the transmission and reception of the alarm information are first discussed.

In FIG. 1, the data output section 118 in the light receiver 31 sends five types of data, namely start data, current light input level, compensation ratio, sensitivity and initial value, approximately every 3 seconds, one type at a time. The status information is composed of current light input level, compensation ratio, sensitivity and initial value. These types of status information are sent to the tester unit 75 approximately every 3 seconds to let the tester unit 75 know the status of the light receiver.

The transmission timing of every 3 seconds is synchronized with the emission timing of the light emitting element 53 in the light emitter unit 42. Namely, each time the light receive element 54 in the light receiver 31 receives light from the light emitting element 53, the data output section 118 sends the status information so that the tester unit 75 indicates updated information.

As the start data, any type of data may be acceptable as long as its parity bit is different from the parity bits of the remaining data. In this embodiment, as already described, the parity bit of the start data is an odd parity. The data bits of the start data are set to be 1s, and thus, the parity bit is also 1 so that its sum is an odd parity.

The current light input level is the A/D converted value given by the A/D converter 68 in response to light input to the light receiver 31.

The compensation ratio ranges from −50% to +50%. The data bits are 8 bits in total, and are thus capable of conveying a value ranging from 0 to 255.

Figure 9:
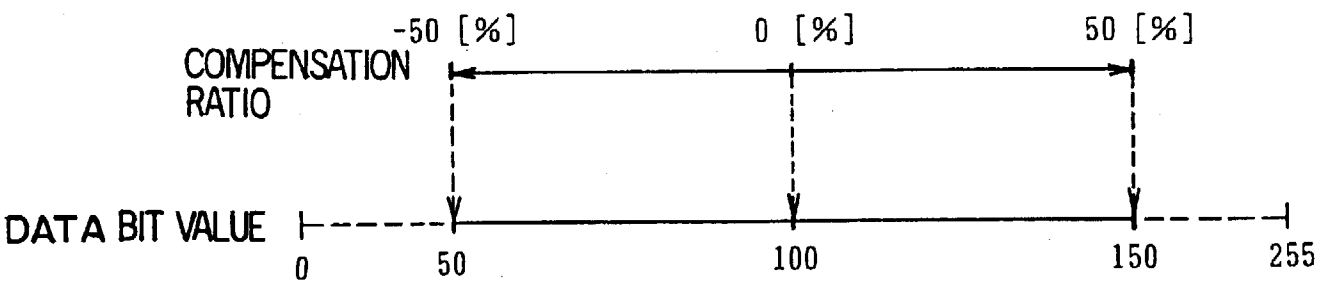
FIG. 9 is a diagram showing the relationship between the compensation ratio and data bit value.

As shown in FIG. 9, the compensation ratio is related to data bits and then sent to the data analyzing block 113 in the tester unit 75: namely, the data bits are set to be 100 when the compensation ratio is 0%, the data bits are set to be 50 when the compensation ratio is −50%, and the data bits are set to be 150 when the compensation ratio is +50%. Therefore, the data bits range from 50 to 150. The data bits indicative of any number within the ranges of 0 through 49 and 151 through 255 remain unused.

The range selection switch 37 switches sensitivity setting resistors disposed in the sensitivity input circuit 57 to divide voltage, and the divided voltage is applied to the A/D converter 68. The A/D converted value is sent to the tester unit 75 as the sensitivity value.

Specifically, the sensitivity setting resistors are connected in series with the reference resistor in the sensitivity input circuit 57. The range selection switch 37 switches the sensitivity setting resistors to perform voltage division. The divided voltage is A/D converted, and the A/D converted value is sent to the control block 50 as the sensitivity data.

The control block 50 reads the A/D converted value, and converts it into a relative sensitivity referring to the sensitivity table 119 in FIG. 5. For example, when voltage division operation in the sensitivity input circuit 57 and A/D conversion operation result in an A/D converted value of 35, the control block 50 determines that sensitivity is 15%. When the A/D converted value ranges within 00 through 31, the control block 50 determines that the detector is in adjustment phase.

The sensitivity data the data output section 118 in the control block 50 sends to the tester unit 75 is the A/D converted value given by the A/D converter 68, rather than the sensitivity obtained from the sensitivity table 119. The tester unit 75 also has the sensitivity table 120 that is the same as that in the light receiver 31. The tester unit 75 can thus know sensitivity from the sensitivity table 120.

Alternatively, sensitivity reading the data output section 118 obtains from the sensitivity table 119 may be sent to the tester unit 75, and the tester unit 75 may display the sensitivity.

The initial value is directly sent as the current light input level is. The data output section 118 thus sends five types of data, one type of data at a time, and this transmission cycle is repeated.

The status information is thus output by the data output section 118, and routed to the tester unit 75 via the status signal output circuits 85, 86.

The status information the tester unit 75 receives is read sequentially and analyzed by the data analyzing section 113. The data analyzing section 113 converts the received A/D converted value into the corresponding sensitivity reading referring to the sensitivity table 120.

After being read and analyzed by the data analyzing section 113, the data are displayed on the display block 116. The data displayed in A/D converted value as they are present some difficulty in recognizing them at a glance. Instead, the data are displayed in % to be intuitively recognizable. For example, the display block 116 gives current light input level 100%, compensation ratio 1%, compensated light input level 99%, sensitivity 70%, relative to the initial value of 100% in this case.

Analyzed data given by the data analyzing section 113 are stored in the memory section 115. This arrangement allows the present data to be compared with the past data. The data stored in the memory section 115 are output to the outside via the output terminal 117 and thus the status of the light receiver 31 is recognized from the outside.

Specifically, a personal computer or printer may be connected to the output terminal 117 to analyze data. Alternatively, the memory section 115 may be dispensed with and a printer is connected to the output terminal 117 to plot data on it to analyze data on each performance test session. Such an arrangement allows the change in data to be continually monitored. Alternatively, the memory section 115 may be constructed of a detachable memory card. Data stored in the memory card are available in a portable manner.

Since the status information is output from the data output section 118 of the control block 50 and analyzed by the data analyzing section 113 of the tester unit 75 as described above, a user can monitor exactly the status of the light receiver 31 by referring to the current light input level, compensated light input level, compensation ratio, sensitivity and initial value, compared to the prior art in which the compensated light input level only is available. Such a exact monitoring offers a timely chance for maintenance personnel to replace early the elements when they collect dirt.

The single line link to conduct a plurality of types of status information simplifies the design of the system and reduces the cost of the system.

The present invention does not require that both the data analyzing section 113 and the display block 116 be contained in the tester unit 75. The tester unit 75 may be provided with the output terminal 117 only. The data analyzing section 113 and the display block 116 may be incorporated into a notebook personal computer which is a separate unit external to the tester unit 75. This unit may be connected to the tester unit 75 via the output terminal 117 in time of need. Such an arrangement implements lightweight and low-cost design into the tester unit 75. Alternatively, both the data analyzing section 113 and the display block 116 may be incorporated into the receiver 46 or any other information display unit.

The operation of the transmission and reception of the alarm information is now discussed.

In its normal operation, the light receiver 31 constantly monitors fire and any glitch in the system. When the light receiver 31 detects a fire, the control block 50 sends the fire signal to the receiver 46 via the fire signal output circuit 71 and at the same time generates a pulse with the pulselength B fire signal at the pulse generator section 82.

When the light receiver 31 detects a glitch in the system, the control block 50 sends the irregularity signal to the receiver 46 via the irregularity signal output circuit 63, and at the same time generates a pulse with the pulselength of irregularity signal at the pulse generator section 82.

The pulse generator section 82 sets up predetermined pulselengths according to the type of alarm information. For example, a positive pulse having a pulselength of 10 ms is generated to indicate a fire, and a positive pulse having a pulselength of 5 ms is generated to indicate a glitch. Namely, the normally low signal is driven high for a duration of 10 ms when a fire breaks out.

The alarm information having different pulselengths generated by the pulse generator section 82 is sent to the tester unit 75, as a positive pulse, via the photocopier 93 and the inverter 94.

The pulse applied at the terminal S1B of the tester unit 75 goes to the pulselength determining circuit 108, where its pulselength is determined.

Namely, when the pulselength is 10 ms, the pulselength determining circuit 108 identifies the incoming pulse as a fire signal and causes the fire lamp 110 to light. When the pulselength is 5 ms, the pulselength determining circuit 108 identifies the incoming pulse as an irregularity signal and causes the irregularity lamp 111 to light.

To conduct performance test to the light receiver, the test switch 107 in the tester unit 75 is turned to the contact point a side.

When the test switch 107 is turned to the contact point a side, the 12 V test signal is sent to the light receiver 31 via the terminal TEB. The test switch 107 must remain on its contact point a side until the performance test ends.

The test signal is sent to the control block 50 via the test signal detector circuits 80, 81. Namely, the test signal is applied to the terminal TEA in the light receiver 31, and routed via the zener diode 87 and the resistor 88 to the light emitting diode 90 to light it. The control block 50 receives the test signal when the phototransistor 91 picks up light from the light emitting diode 90.

When the control block 50 receives the test signal, it generates a pseudo-fire state, sending a fire signal to the receiver 46.

The pulse generator section 82 generates a pulse of a pulselength of 10 ms for fire signal requirement.

The pulse of fire signal generated at the pulse generator section 82 is sent to the tester unit 75 via the alarm signal output circuits 83, 84.

The pulse at the terminal S1B in the tester unit 75 is determined by the pulselength determining circuit 108. Namely, the pulselength determining circuit 108 determines that the pulselength of the pulse is 10 ms, and then causes the fire lamp 110 to light.

The lighting of the fire lamp 110 indicates that the operation test has been successfully completed.

If the reset switch 112 is pressed continuously for about 3 seconds, the pulselength determining circuit 108 is reset, causing the fire lamp 110 and irregularity lamp 111 to go off.

Figure 10:
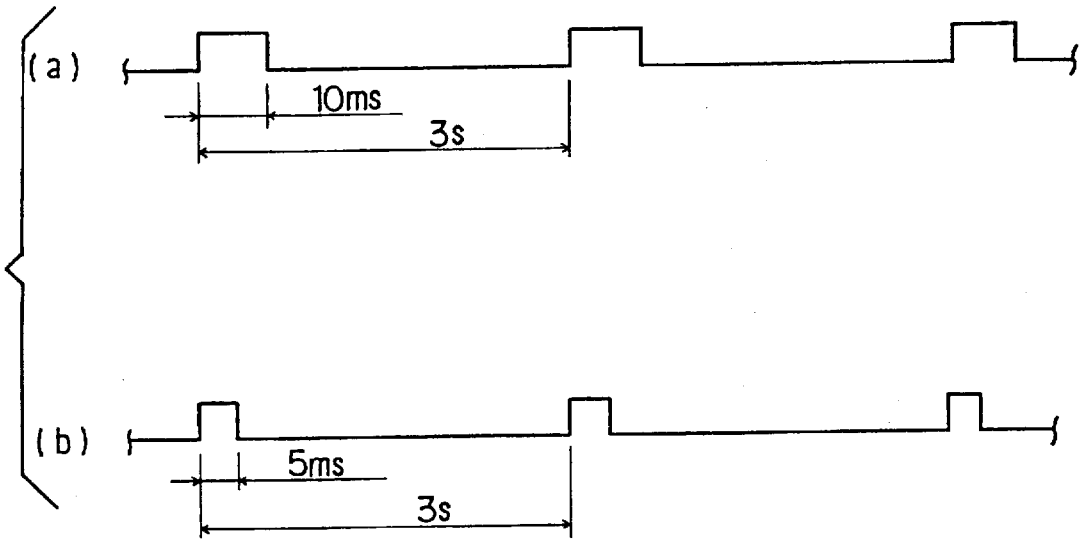
FIG. 10 shows the transmission interval between the fire signal and the irregularity signal.
Figure 11:
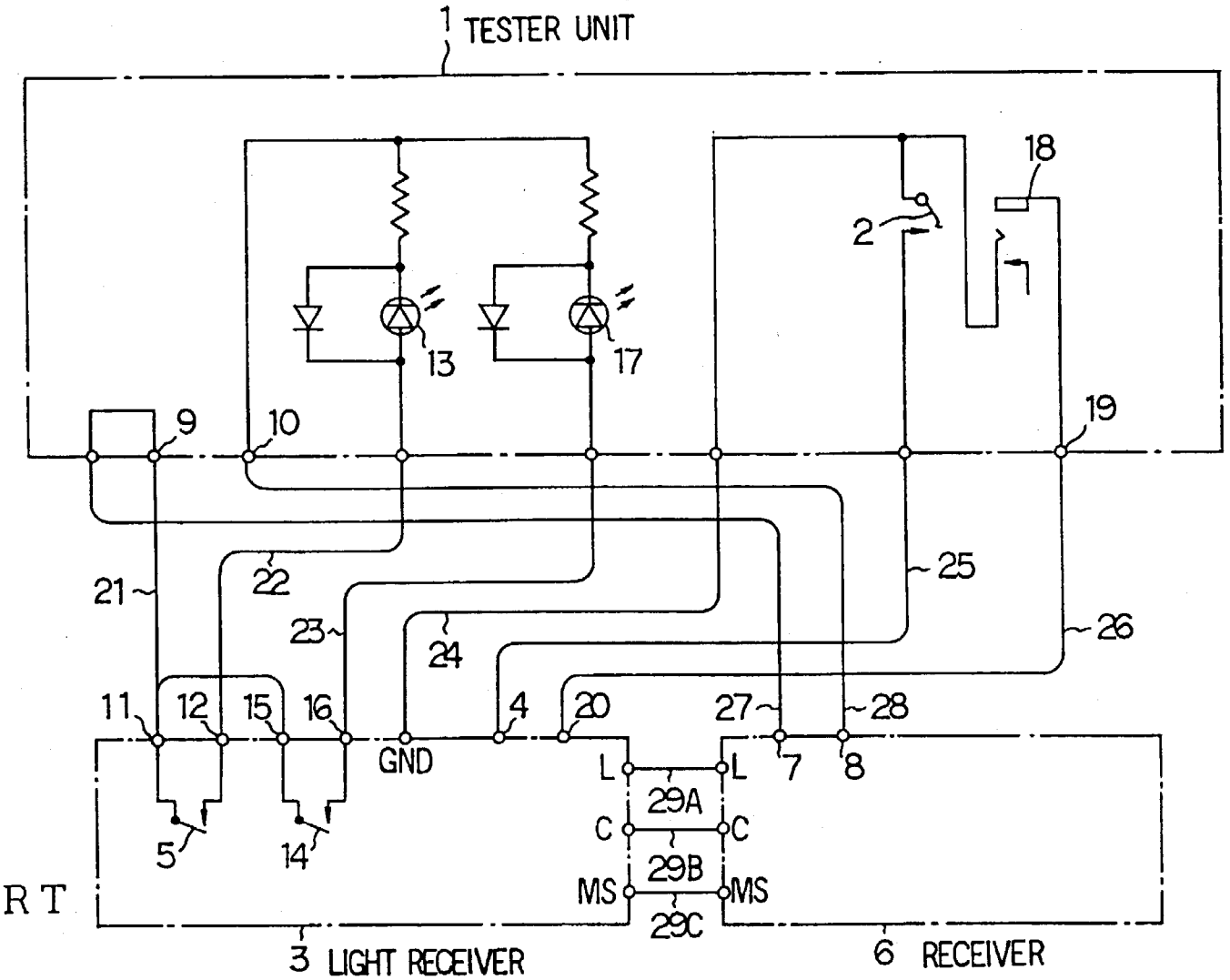
FIG. 11 shows the prior art.

FIG. 10(*a*) shows the interval of the fire signal, and FIG. 10(*b*) shows the interval of the irregularity signal. When the light receiver 31 detects continuously fire or a glitch, the fire signal (pulselength 10 ms) or the irregularity signal (pulselength 5 ms) is transmitted every 3 seconds in succession.

As already described, the timing of 3 second interval is designed to be synchronized with the emission timing of the light emitting element 53 in the light emitter unit 42. Namely, each time the light receive element 54 in the light receiver 31 receives light from the light emitting element 53, the light receiver 31 determines a fire or a glitch based on the light input level and sends its determination result responsive to the light input level to the tester unit 75.

Since the determination is performed each time the light receive element 54 receives light, the transmission of the fire signal to the tester unit 75 ends when the light input level returns to its original level after fire has been once detected. In the same way, the transmission of the irregularity signal to the tester unit 75 ends when the light input level returns to its original level after a glitch has been once detected.

Once the fire lamp 110 or the irregularity lamp 111 in the tester unit 75 has lit, it remains continuously lit until the reset switch 112 has been continuously pressed for about 3 seconds.

In this way, when the light receiver 31 sends the alarm information to the tester unit 75, the pulselengths of each type of alarm information are set according to the type of alarm information. A pulse having a pulselength that agrees with the type of alarm information transmitted is sent to the tester unit 75. The tester unit 75 determines from the pulselength of the incoming pulse whether the incoming pulse is a fire signal or an irregularity signal. Unlike the prior art which requires dedicated lines for fire signal and irregularity signal, the single line 76 is shared by the fire and irregularity signals. This arrangement simplifies the design of the system and reduces the cost of the system.

In this embodiment, the light receiver 31 sends the alarm and status information to the tester unit 75. Alternatively, the alarm and status information may be sent to a display unit or an alarm unit.

What is claimed is:

1. A projected beam-type smoke detector that is constructed of a light emitter having a light emitting element and a light receiver having a light receive element separately mounted from the light emitter in order to detect a fire by detecting the light attenuation due to the presence of smoke between the light emitting element and the light receive element, said light receiver sending to a receiving unit a plurality of types of numerical status information including light receive state data and setting state data of a diversity of setting values determined by monitoring the status of the light emitter and the light receiver, said projected beam-type smoke detector comprising: data output means in the light receiver for outputting serially the plurality of types of status information a start data being provided at the head of said plurality of types of numerical status information, said start data being detectable as start position of said status information by said receiving unit; and status signal output means for sending said plurality of types of numerical status information from said data output means to said receiving unit, said plurality of types of numerical status information being sent sequentially in predetermined order and periodically.

2. The projected beam-type smoke detector according to claim 1, wherein the plurality of types of status information includes current light input level, compensation ratio, sensitivity and initial value.

3. A receiving unit, in a projected beam-type smoke detector that is constructed of a light emitter having a light emitting element and a light receiver having a light receive element separately mounted from the light emitter in order to detect a fire by detecting the light attenuation due to the presence of smoke between the light emitting element and the light receive element, said light receive element receiving from said light receiver a plurality of types of numerical status information including light receive state data and setting state data of a diversity of setting values determined by monitoring the status of the light emitter and the light receiver, said receiving unit comprising data analyzing means for sequentially analyzing said plurality of types of numerical status information, said plurality of types of numerical status information being sent sequentially in predetermined order and periodically, a start data being provided at the head of said plurality of types of numerical status information, said start data being detectable as start position of said status information by said data analyzing means, analyzing said data analyzing means being performed by allowing said plurality of types of numerical status information, after said start data, respond to order for receiving status information, said order for receiving status information being pre-stored by said data analyzing means, and said data analyzing means detecting said start data and then analyzing said plurality of types of numerical status information after said start data.

4. The projected beam-type smoke detector and the receiving unit according to claim 3, wherein said receiving unit is a tester unit which conducts a performance test by sending a test signal to the projected beam-type smoke detector.

5. The receiving unit according to claim 3, further comprising display means for displaying the analyzed data provided by said data analyzing means.

6. The receiving unit according to claim 3, further comprising memory means for storing the analyzed data provided by said data analyzing means.

7. The receiving unit according to claim 6, further comprising output means for outputting the data stored in the memory means.

8. A projected beam-type smoke detector that is constructed of a light emitter having a light emitting element and a light receiver having a light receive element separately mounted from the light emitter unit in order to detect the light attenuation due to the presence of smoke between the light emitting element and the light receive element, said light receiver sending to a receiving unit a plurality of types of alarm information, said projected beam-type smoke detector comprising in said light receiver:

pulse generator means for generating pulses having different pulselengths according to the type of said alarm information; and alarm signal output means for sending to said receiving unit the pulses having different pulselengths generated by said pulse generator means.

9. A receiving unit in a projected beam-type smoke detector that is constructed of a light emitter having a light emitting element and a light receiver having a light receive element separately mounted from the light emitter in order to detect a fire by detecting the light attenuation due to the presence of smoke between the light emitting element and the light receive element, said light receive element receiving from the light receiver a plurality of types of alarm information, said receiving unit comprising: pulselength determining means for identifying the type of the alarm information by recognizing pulselength of the pulse sent from the projected beam-type smoke detector, the relation between said plurality of types of alarm information and pulses with different pulselengths being pre-stored in said pulselength determining means, said pulselength determining means recognizing the pulselength of the pulse when said pulselength determining means detects said pulse, said pulses with different pulselengths being sent by said light receiver when said light receiver detects said plurality of types of alarm information, said pulselength determining means identifying the type of the alarm information on the basis of the relation between said plurality of types of alarm information and pulses with different pulselengths; and display means for displaying the alarm information identified by said pulselength determining means.

10. The receiving unit according to claim 9, wherein said receiving unit is a tester unit which conducts a performance test by sending a test signal to the projected beam-type smoke detector.

11. The projected beam-type smoke detector according to any of the claims 8 or 9, wherein said plurality of types of alarm information comprise a fire signal and an irregularity signal.

12. The receiving unit according to claim 9, wherein said pulselength determining means comprises reset means which resets the pulselength determining means when the reset means is pressed for a predetermined duration of time.

* * * * *